US006357081B1

(12) United States Patent
Bender

(10) Patent No.: US 6,357,081 B1
(45) Date of Patent: Mar. 19, 2002

(54) TAKE APART DOOR HINGE WITH LOCK-ON CAM

(75) Inventor: Frederick F. Bender, Lyon, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/401,097

(22) Filed: Sep. 22, 1999

(51) Int. Cl.[7] ..... E05D 7/10
(52) U.S. Cl. ..... 16/201; 16/255; 16/334
(58) Field of Search ..... 16/261, 267, 265, 16/260, 254; 296/146.11, 146.12, 148; 49/502

(56) References Cited

U.S. PATENT DOCUMENTS

| | | | | | |
|---|---|---|---|---|---|
| 4,672,715 | A | * | 6/1987 | Beckwith | 16/334 |
| 4,720,895 | A | | 1/1988 | Peebles | |
| 4,765,025 | A | * | 8/1988 | Salazar | 16/261 |
| 4,766,643 | A | * | 8/1988 | Salazar | 16/22 |
| 4,807,331 | A | * | 2/1989 | Calucci | 16/262 |
| 4,846,687 | A | | 7/1989 | Calcaterra et al. | |
| 4,932,101 | A | * | 6/1990 | Lualdi | 16/255 |
| 5,297,314 | A | | 3/1994 | Bender et al. | |
| 5,404,618 | A | | 4/1995 | Heiler | |
| 5,644,817 | A | | 7/1997 | Bender et al. | |
| 5,682,646 | A | | 11/1997 | Tyler, IV et al. | |
| 5,787,550 | A | | 8/1998 | Bender | |
| 5,850,673 | A | * | 12/1998 | Wood et al. | 16/224 |
| 6,038,738 | A | * | 3/2000 | Neag et al. | 16/324 |
| 6,070,296 | A | * | 6/2000 | Abeln et al. | 16/261 |

* cited by examiner

*Primary Examiner*—Lynne H. Browne
*Assistant Examiner*—Mark Williams
(74) *Attorney, Agent, or Firm*—Mark P. Calcaterra

(57) ABSTRACT

A disjoinable hinge mechanism having a locking cam is provided. The hinge mechanism includes a hinge assembly having a hinge pin which pivotably couples a first hinge structure to a second hinge structure. The hinge mechanism also includes a cam pivotably coupled to the hinge pin and a third hinge structure which includes a cam follower. The cam is positionable between a released position and an engaged position. The cam does not engage the cam follower when positioned in the released position. The cam engages the cam follower when positioned in the engaged position. The cam is adapted to be moved into the engaged position when an associated closure member is moved into a closed position. Thereafter, the cam remains in the engaged position during normal operation of the closure member. The second hinge structure may also include a set of locator pins which engage mounting apertures in the third hinge structure. The locator pins permit the hinge member to be rejoined so that the hinge assembly aligns correctly to the third hinge member after the hinge mechanism has been disjoined.

23 Claims, 6 Drawing Sheets

TAKE APART DOOR HINGE WITH LOCK-ON CAM

BACKGROUND OF THE INVENTION

1. Technical Field

The present invention relates generally to closure member hinge mechanisms and more particularly to a hinge mechanism for a closure member which permits the closure member to be easily removed and reinstalled in an accurate manner.

2. Discussion

It has long been recognized that three-piece disconnectable hinges may be advantageous over conventional two-piece hinges in certain applications where a closure member is installed to a device and subsequently removed and reinstalled during the course of the assembly of the device. U.S. Pat. No. 4,720,895 entitled Quick-Disconnect Door Hinge, U.S. Pat. No. 4,766,643 entitled Vehicle Door Hinge Having Vertically Separable Pivotal Connections, and U.S. Pat. No. 5,297,314 entitled Three-Piece Lateral Take-Apart Door Hinge Assembly, all of which are hereby incorporated by reference as if fully set forth herein, each disclose a multi-piece door hinge assembly having first and second portions which are disjoined by removing one or more fasteners which secure the portions together. At least one of these hinge mechanisms requires the use of specially designed fasteners which aid in the realignment of the hinge portions.

While such hinge mechanisms have received general acceptance, several drawbacks have been noted. One primary drawback has been the need for threaded fasteners to join and disjoin the portions of the hinge mechanism. Problems typically associated with the routine installation and removal of fasteners include loss of the fasteners, damage to the threads of the fastener or to an associated portion of the hinge mechanism, significant expenses associated with the tooling and labor for the removal and subsequent re-installation of the fasteners, and alignment problems associated with the level of clamping forces produced and the fastening sequence with which the fasteners are tightened.

Another primary drawback relates to the manner in which the portions of the hinge assembly are realigned. The above-referenced hinge mechanisms typically require the use of assembly tooling such as fixtures or guides that align the vehicle door to the vehicle body in a predetermined orientation and relationship until the fasteners for securing the portions of the hinge mechanism together are threadably engaged. Such tooling is typically expensive and does not add value to the vehicle.

SUMMARY OF THE INVENTION

It is one object of the present invention to provide a hinge mechanism with a locking cam which permits the hinge mechanism to be readily disjoined and rejoined.

It is another object of the present invention to provide a hinge mechanism with an integral alignment mechanism which permits the hinge mechanism to be easily and accurately rejoined.

A disjoinable hinge mechanism having a locking cam is provided. The hinge mechanism includes a hinge assembly having a hinge pin which pivotably couples a first hinge structure to a second hinge structure. The hinge mechanism also includes a cain pivotably coupled to the hinge pin and a third hinge structure which includes a cam follower. The cam is positionable between a released position and an engaged position. The cam does not engage the cam follower when positioned in the released position. The cam engages the cam follower when positioned in the engaged position. The cam is adapted to be moved into the engaged position when an associated closure member is moved into a closed position. Thereafter, the cam remains in the engaged position during normal operation of the closure member. The second hinge structure may also include a set of locator pins which engage mounting apertures in the third hinge structure. The locator pins permit the hinge member to be rejoined so that the hinge assembly aligns correctly to the third hinge member after the hinge mechanism has been disjoined.

Additional advantages and features of the present invention will become apparent from the subsequent description and the appended claims, taken in conjunction with the accompanying drawings.

BRIEF DESCRIPTION OF THE DRAWINGS

FIG. 6 is a top view of a portion of the hinge mechanism of FIG. 1;

FIG. 1 2 is a perspective view of a tool for disengaging the cam;

DETAILED DESCRIPTION OF THE PREFERRED EMBODIMENT

Figure 1:
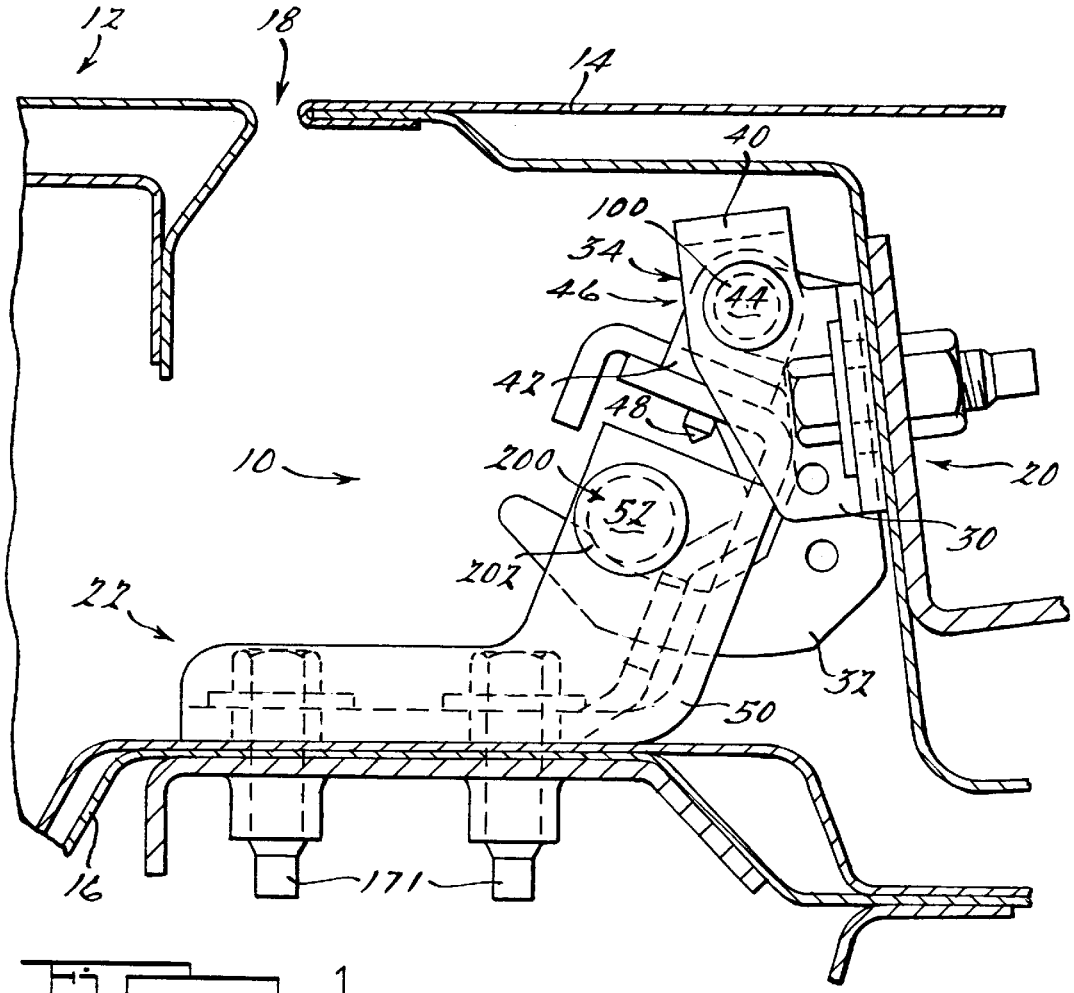
FIG. 1 is a partial sectional view of a vehicle illustrating a hinge mechanism constructed in accordance with the teachings of a preferred embodiment of the present invention, with the hinge mechanism in an orientation such that the vehicle door is in a closed position.
Figure 1A:
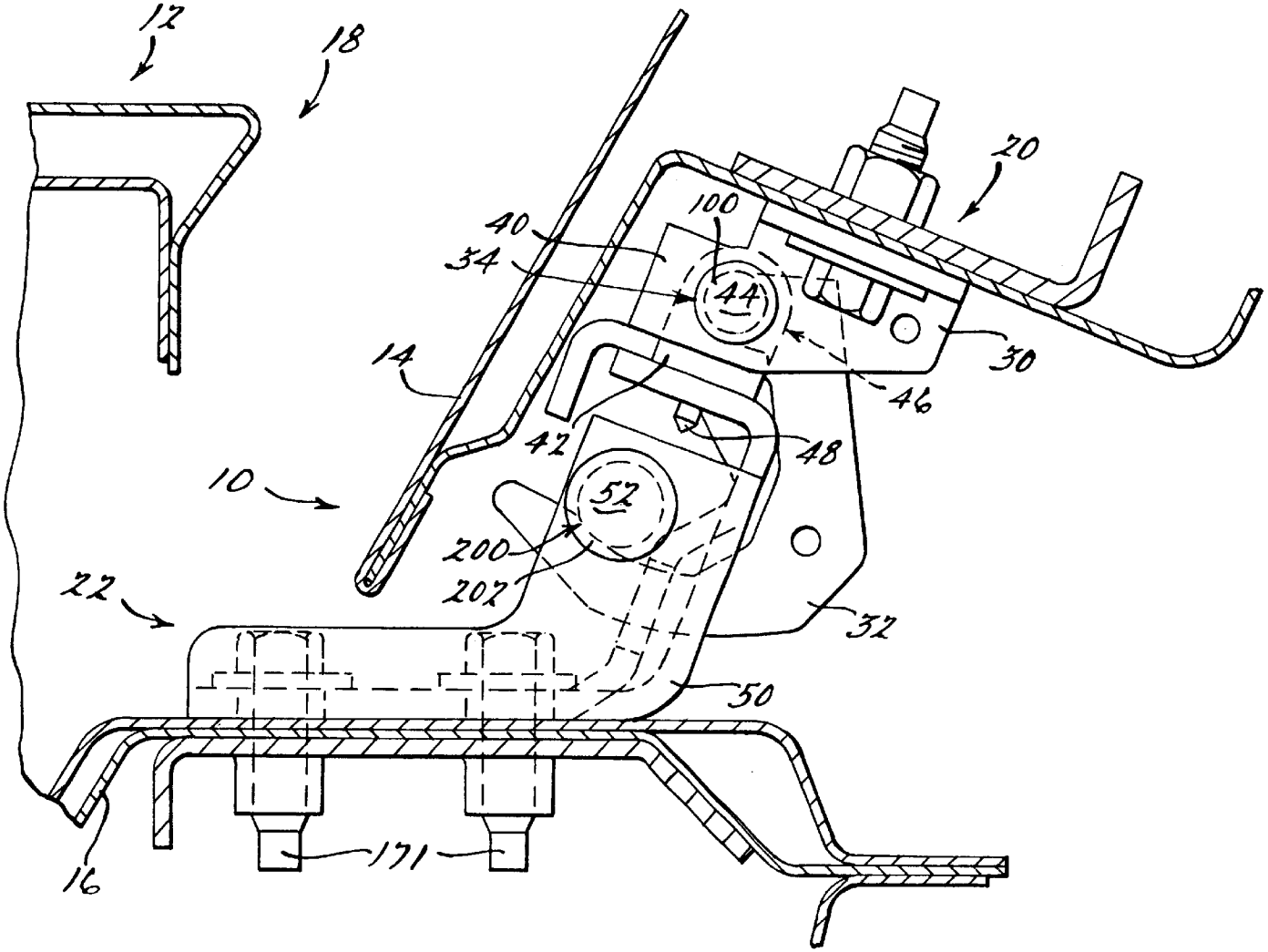
FIG. 1A is a partial sectional view similar to that of FIG. 1 but illustrating the hinge mechanism in an orientation such that the vehicle door is in an open position.

Referring now to FIGS. 1 and 1A of the drawings, a hinge mechanism constructed in accordance with the teachings of the present invention is generally indicated by reference numeral 10. Hinge mechanism 10 is shown in operative association with an apparatus 12 having a closure member 14 and a frame structure 16 which defines a closure member aperture 18. Although the particular apparatus 12 illustrated is an automotive vehicle, it will be understood that the teachings of the present invention have applicability to other types of devices and as such, will not be limited in application to automotive vehicles.

A first hinge portion 20 of hinge mechanism 10 is coupled to closure member 14 and a second hinge portion 22 of hinge mechanism 10 is coupled to frame structure 16. First hinge portion 20 includes a hinge assembly 30, a cam member 32 and a cam positioning member 34. Hinge assembly 30 includes a first hinge structure 40, a second hinge structure 42, a hinge pin 44, a pair of pin bushings 46 and a pair of locators 48. Second hinge portion 22 includes a third hinge structure 50 and a cam follower 52.

Figure 3:
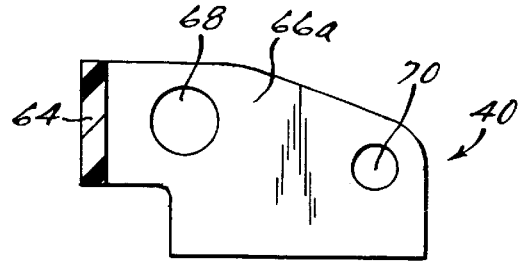
FIG. 3 is a view taken along the line 3—3 of FIG. 2.
Figure 2:
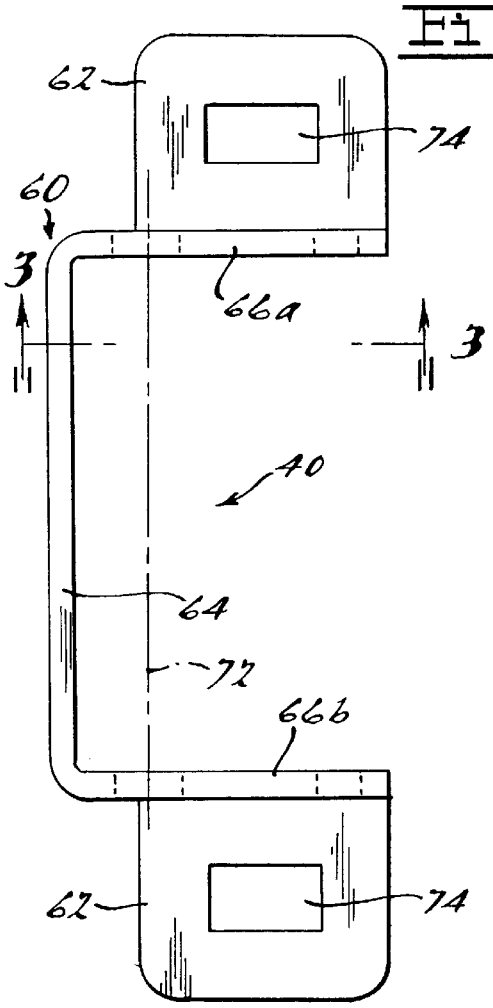
FIG. 2 is a front view of a portion of the hinge mechanism of FIG. 1.
Figure 5:
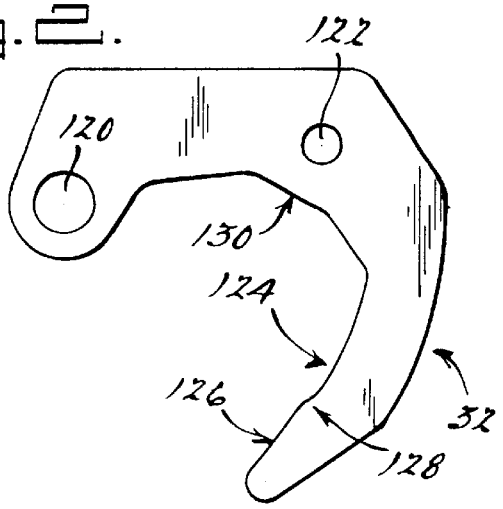

In FIGS. 2 and 3, first hinge structure 40 is illustrated as being a stamped metal fabrication having a U-shaped yoke 60 and a pair of mounting flanges 62. Yoke 60 includes a central member 64 and a pair of fork members 66*a*, 66*b* which are coupled to opposite ends of central member 64. A first pin aperture 68 and a first release aperture 70 are formed into each of the fork members 66. First pin apertures 68 are spaced apart from central member 64 and a hinge pin axis 72 is formed therethrough.

Each of the mounting flanges 62 is coupled to a fork member 66 and extends outwardly therefrom. Each mounting flange 62 also includes a first securing aperture 74 which permits first hinge portion 20 to be fixedly but removably secured to closure member 14 through a pair of conventional fasteners (not shown).

Figure 5:
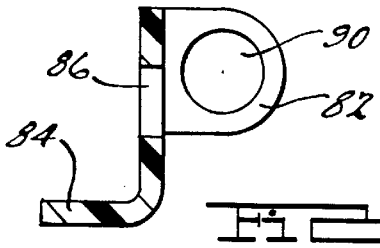
FIG. 5 is a view taken along the line 5—5 of FIG. 4.
Figure 4:
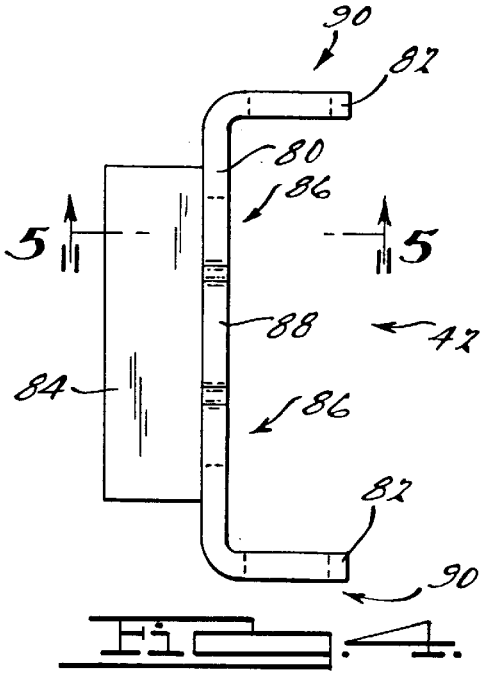
FIG. 4 is a front view of a portion of the hinge mechanism of FIG. 1.

In FIGS. 4 and 5, second hinge structure 42 is illustrated as including a base member 80, a pair of trunnions 82 and a tongue 84. Base member 80 includes a pair of locator apertures 86 which are spaced apart along a generally vertical axis. Base member 80 also includes a cam recess 88 which is centered between the pair of locator apertures 86. Each of the trunnions 82 is coupled to base member 80 and extend outwardly therefrom in a generally perpendicular direction. Each trunnion 82 includes a second pin aperture 90. Tongue 84 is coupled to base member 80 and extends outwardly therefrom in a generally perpendicular direction.

Hinge pin 44 is conventional in construction and need not be described in significant detail. Briefly, hinge pin 44 includes a first headed portion 100, a knurled portion (not shown), a body portion 104 and a second headed portion 106. The knurled portion is typically larger in diameter than body portion 104 and first pin apertures 68. As such, insertion of the knurled portion into either of the first pin apertures 68 causes the associated fork member 66 to fixedly engage the knurled portion, thereby inhibiting withdrawal of hinge pin 44 from first hinge structure 40. Second headed portion 106 is formed after first hinge portion 20 has been assembled and inhibits hinge pin 44 from being removed therefrom. Second headed portion 106 is preferably conventionally formed in a staking or spinning operation. Pin bushings 46 are also conventional in construction and need not be described in significant detail. Briefly, pin bushings 46 include a thrust flange 110 and a body portion 112. Thrust flange 110 is washer-shaped and includes a low-friction coating, such as Teflon, on its thrust surface 114. Body portion 112 is a hollow cylinder and includes a low-friction coating, such as Teflon, on its interior surface.

In FIG. 6, cam member 32 is illustrated as being a generally C-shaped member having a third pin aperture 120, a second release aperture 122 and an arcuate cam surface 124. Arcade cam surface 124 is shown to include a first portion 126, a second portion 128 and a third portion 130. Third pin aperture 1 20 is adapted to receive cam positioning member 34.

Figure 7:
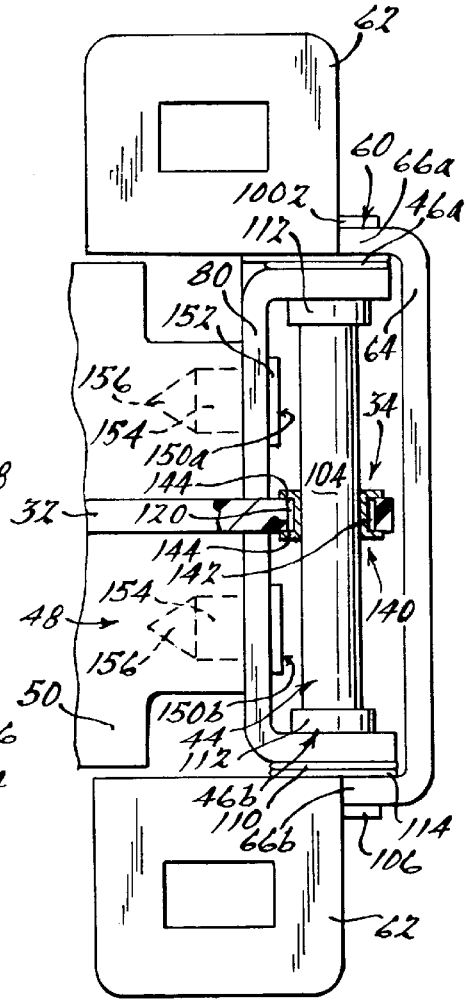
FIG. 7 is a rear view of a portion of the hinge mechanism of FIG. 1.

In FIG. 7, cam positioning member 34 is illustrated as being a generally cylindrical bushing 140 which is fixedly coupled to hinge pin 44 through a conventional securing means such as press-fitting or adhesives. Bushing 140 includes a body portion 142 and a pair of flanges 144. Body portion 142 is sized to fit within third pin aperture 120 to permit cam member 32 to rotate about body portion 142. Each of the flanges 144 is fixedly coupled to an opposite end of body portion 142. Each of the flanges 144 is sized larger than third pin aperture 120 to inhibit axial movement of cam member 32 along hinge pin 44.

In the particular embodiment illustrated, each of the locators 48 are a rivet 150 having a head portion 152, a body portion 154 and an insertion portion 156. The body portions 154 of rivets 150 are sized to fit within the locator apertures 86 in the second hinge structure 42. Body portions 154 are shown to be generally cylindrical and positioned perpendicular to base member 80. Each of the insertion portions 156 is coupled to the body portion 154 and is conical in shape. Head portions 152 are each coupled to a distal end of their respective body portions 154 and are operable for fixedly securing body portion 154 to base member 80.

Locators 48 are fixedly secured to base member 80. One of the pair of pin bushings 46 is inserted into each of the second pin apertures 90 in the trunnions 82 of the second hinge structure 42. Second hinge structure 42 is positioned proximate to first hinge structure 40. Cylindrical bushing 140 is coupled to the third pin aperture 120 of cam member 32 and the resulting assembly is positioned proximate to first and second hinge structures 40 and 42. Hinge pin 44 is inserted through the first pin aperture 68 in fork member 66*a* and pin bushing 46*a*. Hinge pin 44 is next pressed through cylindrical bushing 140. Hinge pin 44 is then pressed through pin bushing 46*b* and the first pin aperture 68 in fork member 66*b*.

Pin bushings 46 permit second hinge structure 42 to rotate about hinge pin axis 72. The thrust surfaces 114 of the thrust flanges 110 contact the fork members 66 so as to minimize clearance between the first and second hinge structures 40 and 44 while providing a low-friction bearing surface. Cam member 32 may freely rotate about hinge pin axis 72 due to the slip-fit condition between it and bushing 140.

Figure 8:
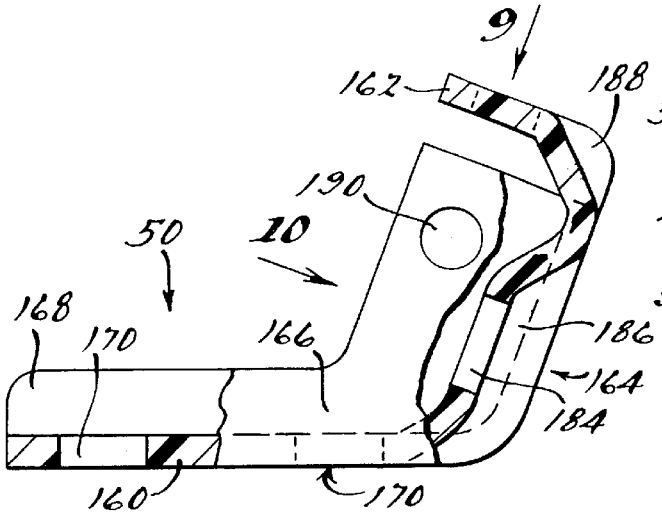
FIG. 8 is a top view of a portion of the hinge mechanism shown in FIG. 1.
Figure 9:
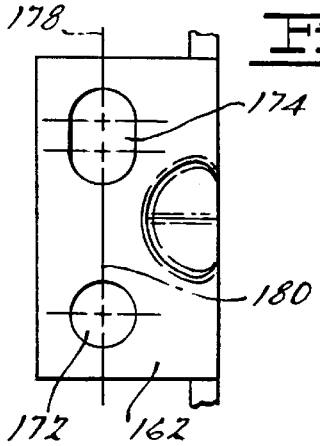
FIG. 9 is an end view of a portion of the hinge mechanisim shown in FIG. 8.
Figure 10:
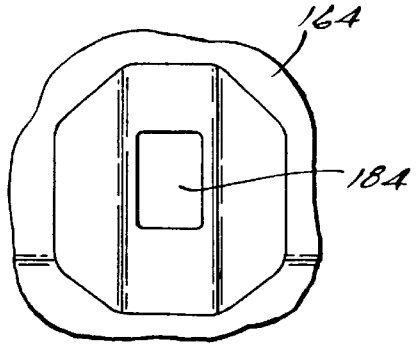
FIG. 10 is a view of a portion of the hinge mechanism taken in direction arrow 10 of FIG. 8.

In FIGS. 8 through 10, third hinge structure 50 is illustrated as a five-sided stamped sheet metal fabrication having a first mounting member 160, a second mounting member 162, a lateral member 164 and upper and lower members 166 and 168, respectively. First mounting member 160 includes a pair of second securing apertures 170 which permit third hinge structure 50 to be fixedly but removably coupled to frame structure 16 through a pair of conventional threaded fasteners (not shown).

Second mounting member 162 includes first and second mounting apertures 172 and 174, respectively. First mounting aperture 172 extends through second mounting member 162 and is generally cylindrical in shape. Second mounting aperture 174 also extends through second mounting member 162. Second mountinig aperture 174 is slotted, having a minor diameter which is approximately equal to the diameter of first mounting aperture 172. The major axis 178 of second mounting aperture 174 is parallel to the centerline 180 of the first mounting aperture 172. Preferably, major axis 178 and centerline 180 coincide.

Lateral member 164 is shown to include a cam aperture 184 sized to receive cam member 32. Lateral member 164 is fixedly coupled to first mounting member 160 at a first end and to second mounting member 162 at a distal end. A first recessed cavity 186 is formed into the first mounting member 160 and lateral member 164 proximate the cam aperture 184. A second recessed cavity 188 is formed into the second mounting member 162 and lateral member 164 proximate the intersection of these two surfaces.

Upper member 166 is coupled to the top portion of lateral member 164 and to the top portion of first mounting member 160. Lower member 168 is similar in construction to upper member 166 and is coupled to the bottom portion of lateral member 164 and to the bottom portion of first mounting member 160. Upper and lower members 166 and 168 function as gussets, strengthening third hinge structure 50 and preventing relative movement between first mounting member 160 and lateral member 164. Each of the upper and lower members 166 and 168 includes a fourth pin aperture 190.

Referring back to FIGS. 1 and 1A cam follower 52 is illustrated as being a cylindrical pin 200 which is similar in construction to hinge pin 44. Pin 200 is conventional in construction and need not be described in significant detail. Briefly, pin 200 includes a first headed portion 202 a knurled portion (not shown), a body portion 206 and a second headed portion (not shown). The knurled portion is typically larger in diameter than body portion 206 and fourth pin apertures 190. As such, insertion of the knurled portion into either of the fourth pin apertures 190 causes the associated upper or lower member 166 or 168 to fixedly engage the knurled portion, thereby inhibiting withdrawal of pin 200 from third hinge structure 50. The second headed portion of pin 200 is formed after pin 200 has been inserted to third hinge structure 50 and inhibits pin 200 from being removed therefrom. The second headed portion of pin 200 is preferably conventionally formed in a staking or spinning operation.

Figure 11A:
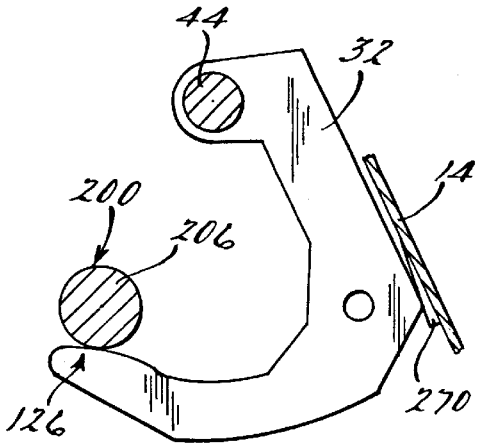
FIG. 11A through 11C are views of a portion of the hinge mechanism of FIG. 1 as the cam is being moved to the engaged position.
Figure 11B:
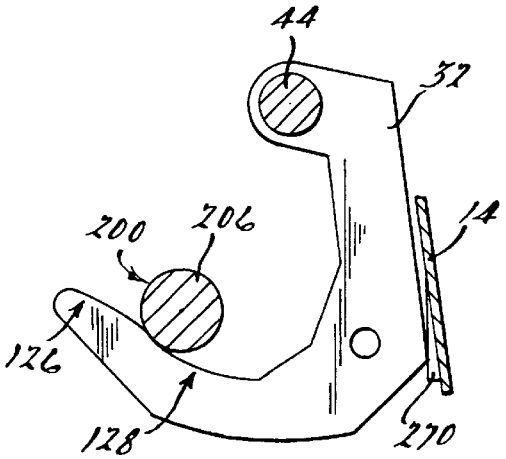

With continued reference to FIG. 1 and 1A and additional reference to FIGS. 11A and 11B, the assembly of hinge mechanism 10 will now be discussed in detail. In assembling hinge mechanism 10, the body portions 154 of the rivets 150 are introduced to the first and second mounting apertures 172 and 174, and the first and second hinge portions 20 and 22 are pushed together such that base member 80 abuts second mounting member 162. As the insertion portions 156 of the rivets 150 are tapered, the rivets 150 act as guide pins and accurately guide the first and second hinge portions 20 and 22 together.

As those skilled in the art should appreciate, the configuration of the body portion 154 of rivets 150 and the first and second mounting apertures 172 and 174 permits the second hinge portion 22 to be installed to the first hinge portion 20 in a highly accurate manner. Essentially, rivet 150*a* acts as a primary datum locator to establish the position of first hinge portion 20 relative to second hinge portion 22 along two datum lines. Rivet 150*b* acts as a secondary datum locator to establish the rotational position of first hinge portion 20 about the two datum lines.

Once the locators 48 have engaged their respective first or second mounting aperture 172 or 174, cam member 32 is then pivoted about hinge pin 44 from a release position, wherein cam member 32 is not engaged to cam follower 52, to an engaged position, wherein cam member 32 engages cam follower 52. In the particular embodiment illustrated, cam member 32 is rotated about hinge pin 44 toward third hinge structure 50 and through cam aperture 184.

Continued rotation of cam member 32 in this direction causes the first portion 126 of the arcuate cam surface 124 to engage pin 200. Contact between first portion 126 and pin 200 creates a clamping force which tends to draw the first and second hinge portions 20 and 22 together such that base member 80 abuts second mounting member 162. Further rotation of cam member 32 in this direction increases the clamping force until pin 200 contacts the second portion 128 of arcuate cam surface 124. The second portion 128 of arcuate cam surface 124 is operable for inhibiting cam member 32 from returning to the release position.

When the second portion 128 of arcuate cam surface 124 engages pin 200, cam member 32 is operable for maintaining a predetermined minimum clampload on the first and second hinge portions 20 and 22 which is transmitted through base member 80 and second mounting member 162. The first and second recessed cavities 186 and 188 increase the strength of third hinge structure 50 as well as prevent contact between the third portion 130 of the arcuate cam surface 124 and the third hinge structure 50.

Figure 12:
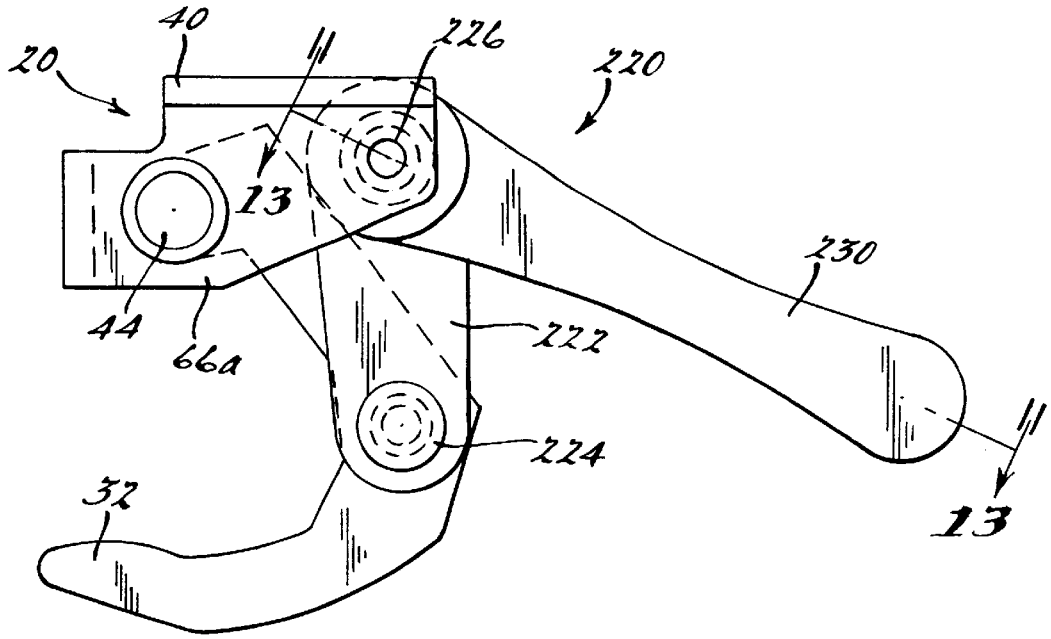
Figure 13:
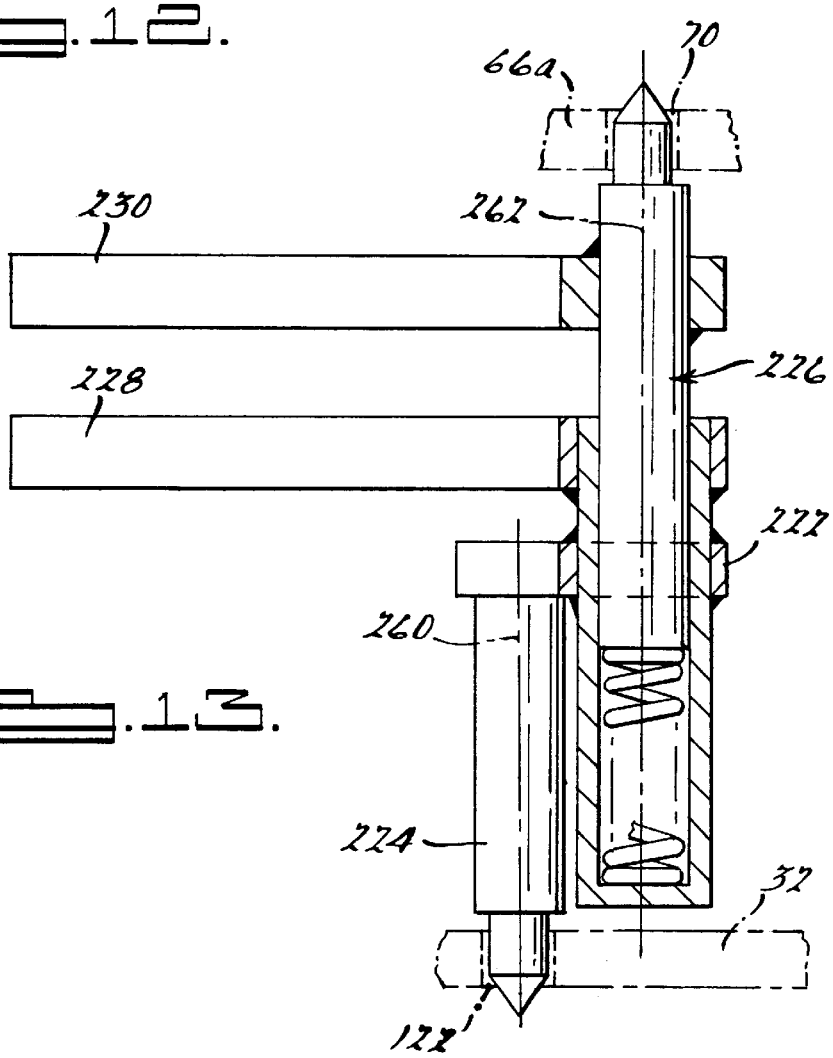
FIG. 13 is a cross-sectional view taken along the line 13—13 of FIG. 12.

Typically, hinge mechanism 10 is provided to an assembly area in a fully assembled condition. Thereafter, a pair of hinge mechanisms 10 are installed to a closure member 14. The sub-assembled closure member 14 is then aligned and secured to a frame structure 16. Removal of the closure member 14 from the frame structure 16 may be easily accomplished through a removal tool, such as the tool shown in FIGS. 12 and 13. Tool 220 is shown to include a plate member 222, a stationary pin 224, a spring-loaded pin assembly 226, a stationary handle 228 and a movable handle 230. Stationary pin 224 is fixedly coupled to plate member 222 and extends therefrom in a first direction along a first axis 260. Spring-loaded pin assembly 226 is coupled to plate member 222 and extends therefrom in a direction opposite the first direction and along a second axis 262 parallel to and spaced apart from the first axis 260. Spring-loaded pin assembly 226 is also permitted to slide along second axis 262. Stationary handle 228 is coupled to plate member 222. Movable handle 230 is coupled to spring-loaded pin assembly 226 such that when movable handle 230 is moved toward stationary handle 228, spring-loaded pin assembly 226 retracts along second axis 262 toward plate member 222.

Preferably, closure member 14 is positioned in a partially open position and tool 220 is engaged to hinge mechanism 10. Specifically, movable handle 230 is moved toward stationary handle 228 to draw spring-loaded pin assembly 226 toward plate member 222. Stationary pin 224 is next positioned into one of the first and second release apertures 70 and 122. In the particular embodiment illustrated, stationary pin 224 is positioned into second release aperture 122. Tool 220 is then rotated about stationary pin 224 so as to align spring-loaded pin assembly 226 to one of the first release apertures 70. When spring-loaded pin assembly 226 is aligned to one of the first release apertures 70, the movable handle 230 is released to permit the spring-loaded pin assembly 226 to enter into the first release aperture 70.

Tool 220 is operable for inhibiting relative motion between cam member 32 and first hinge structure 40. Consequently, moving closure member 14 toward the fully open position causes cam member 32 to move from the engaged position to the release position. Depending upon the length of the closure member 14, the closure member 14 may produce a tremendous mechanical leveraging effect which eliminates the need for other tooling to remove cam member 32 from cam follower 52.

Following the removal of cam member 32 from cam follower 52, the first and second portions of hinge mechanism 10 may be separated to permit closure member 14 to be removed from frame structure 16. Re-installation of closure member 14 to frame structure 16 is greatly simplified as a result of the cam member 32 and locators 48. As discussed above, locators 48 are operable for efficiently and accurately aligning the closure member 14 to the frame structure.

Figure 11C:
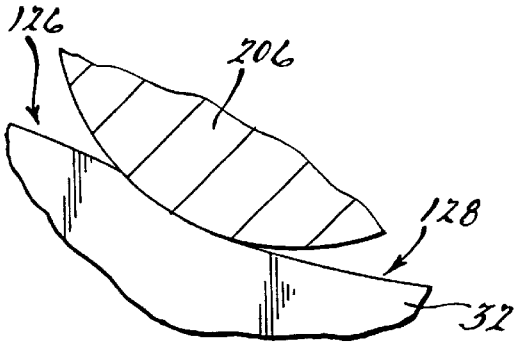

Closure member 14 may also be advantageously employed during the reinstallation process to engage cam member 32 to cam follower 52. Referring back to FIGS. 11A and 11B, contact between cam member 32 and closure member 14 when the closure member 14 is moved from the fully open position to the fully closed position drives cam member 32 from the release position to the engaged position. As specifically shown in FIG. 11C, an installation tool 270 may be employed to ensure that cam member 32 has been placed in the engaged position.

Installation tool 270 is essentially a wedge that is placed between cam member 32 and closure member 14 which takes up any space which is intended to serve as clearance between these two components. Use of such clearance space is conventional and eliminates noise generated by contact between the cam member 32 and closure member 14 when the closure member 14 is placed in the closed position. Installation tool 270 is removed once cam member 32 has been returned to the engaged position.

Figure 14:
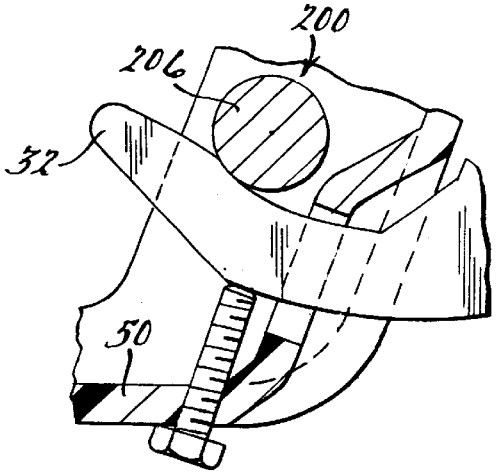
FIG. 14 is a cross-sectional view of a portion of a hinge mechanism constructed according to another preferred embodiment of the present invention.

In FIG. 14 a secondary securing device 280 is shown to include a threaded fastener 282 and a threaded hole 284 formed into the third hinge structure 50' proximate the first recessed cavity 186'. Threaded fastener 282 threadably engages threaded hole 284 and protrudes toward the interior of third hinge structure 50'. The end 286 of threaded fastener 282 is proximate cam member 32 and inhibits its movement toward the release position.

Figure 15:
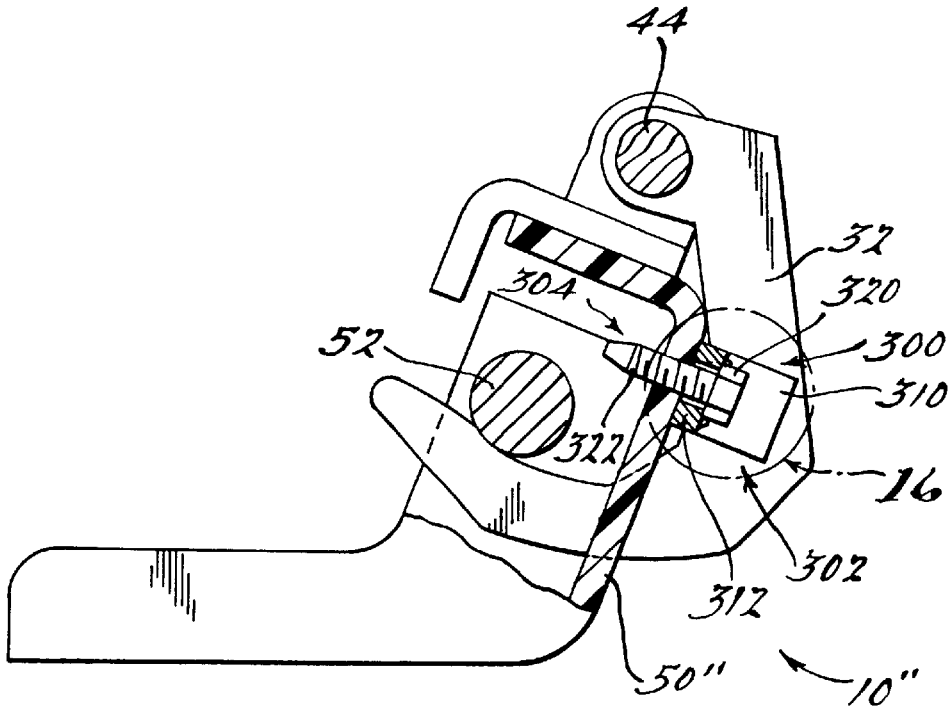
FIG. 15 is a partial sectional view illustrating a portion of a hinge mechanism constructed according to yet another preferred embodiment of the present invention.
Figure 16:
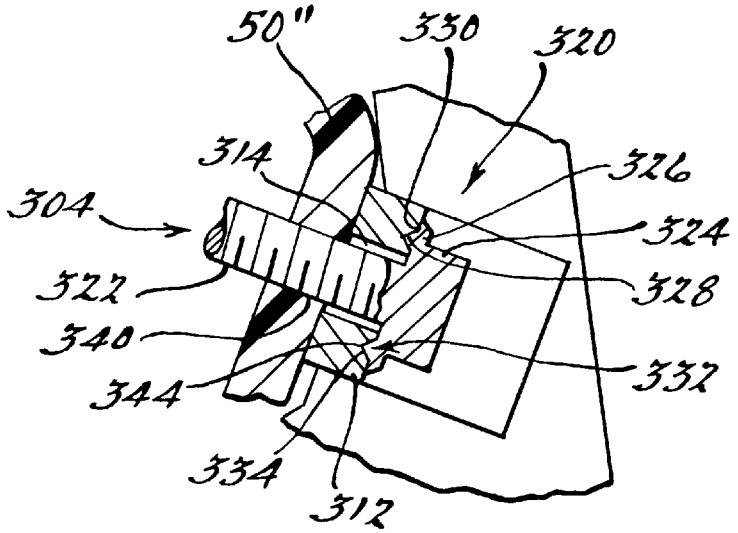
FIG. 16 is an enlarged view of a portion of the hinge mechanism of FIG. 15.

Another secondary securing device 300 is illustrated in FIGS. 15 and 16. Secondary securing device 300 includes a retaining bracket 302 and a threaded fastener 304. Retaining bracket 302 is generally L-shaped and includes a base portion 310 and a leg portion 312. Base portion 310 is fixedly coupled to cam member 32 by a suitable fastening means, such as spot welding. Leg portion 312 includes a fastener aperture 314 which will be discussed in greater detail below.

Fastener 304 includes a head structure 320 and a threaded body portion 322. Head structure 320 includes a conventional drive portion 324 and a flange portion 326. Drive portion 324 is illustrated as being hexagonal in shape to permit fastener 304 to be installed with a standard socket wrench (not shown). Flange portion 326 is adapted to transmit clamping forces to leg portion 312 and includes an annular ring 328 formed into the underside 330 of flange portion 326. Annular ring 328 is illustrated as having tooth 332 with a triangular cross-section. The included angle of the tip 334 of tooth 332 is from about 30 to about 120 degrees and preferably from about 60 to about 90 degrees.

Fastener 304 is installed to hinge mechanism 10" after cam member 32 has engaged cam follower 52. Body portion 322 is introduced through fastener aperture 314 and threadably engaged to a threaded securing aperture 340 in third hinge structure 50". Due to variation in the fabrication of the components and assembly of hinge mechanism 10", fastener aperture 314 is sized well larger in diameter than body portion 322 to permit body portion 322 to threadably engage securing aperture 340. Fastener 304 is rotated sufficiently to permit head structure 320 to transmit a clamping force which tends to draw third hinge structure 50 and leg portion 312 together. The clamping force is initially transmitted through annular ring 328 which causes tooth 332 to machine or deform a corresponding groove 344 into leg portion 312.

In addition to inhibiting cam member 32 from becoming disengaged from cam follower 52, the configuration of secondary securing device 300 in this manner advantageously improves the shear strength of hinge mechanism 10". Engagement of the teeth 332 of annular ring 328 into groove 344 improves the resistance of hinge mechanism 10" to shear forces created by the weight of the closure member 14 and any downward forces that are applied to the closure member 14.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

I claim:

1. A hinge mechanism for a structure having a frame and a closure member, the frame defining an aperture, the hinge mechanism comprising:

a first hinge portion adapted for coupling to the closure member;

a second hinge portion having a cam follower, the second hinge portion adapted for coupling to the frame; and a cam coupled to the first hinge portion and movable between a release position, wherein the cam is not engaged to the cam follower, and an engaged position, wherein the cam engages the cam follower and secures the first and second hinge portions together;

wherein the cam is in the release position prior to installation of the closure member to the frame and is adapted to be moved into the engaged position upon movement of the closure member from an open position to a closed position, thereafter the cam remaining in the engaged position during normal operation of the closure member.

2. The hinge mechanism of claim 1, wherein the cam follower is a pin member.

3. The hinge mechanism of claim 1, wherein the first hinge portion includes a hinge pin and the cam is a hook-shaped structure rotatably coupled to hinge pin.

4. A hinge mechanism for a structure having a frame and a closure member, the frame defining an aperture, the hinge mechanism comprising:

a first hinge portion adapted for coupling to the closure member, the first hinge portion including a hinge pin;

a second hinge portion adapted for coupling to the frame, the second hinge portion having a cam follower and a cam aperture; and a cam coupled to the first hinge portion and movable between a release position and an engaged position, the cam not engaging the cam follower when the cam is in the release position and the cam engaging the cam follower when the cam is in the engaged position, the cam being a hook-shaped structure rotatable coupled to hinge pin, the hook-shaped structure pivoting about the hinge pin and through the cam aperture when the cam is moved to the engaged position;

wherein the cam is in the release position prior to installation of the closure member to the frame and is adapted to be moved into the engaged position upon movement of the closure member from an open position to a closed position, thereafter the cam remaining in the engaged position during normal operation of the closure member.

5. The hinge mechanism of claim 1, further comprising means for secondarily securing the cam in the engaged position, the secondary securing means adapted for coupling the cam to the second hinge portion.

6. The hinge mechanism of claim 5, wherein the secondary securing means includes a threaded fastener.

7. The hinge mechanism of claim 5, wherein the second hinge portion includes a cam aperture and the secondary securing means includes a clip structure, the cam aperture permitting a portion of the cam to pass through a portion of the second hinge portion when the cam is being moved to the engaged position, the clip structure extending at least partially through the cam aperture and engaging the second hinge portion and the cam to inhibit movement therebetween.

8. The hinge mechanism of claim 1, wherein the first hinge portion includes a first release aperture and the cam includes a second release aperture, the first and second release apertures adapted to receive a release tool, the release tool adapted to inhibit relative motion between the cam and the closure member.

9. The hinge mechanism of claim 8, wherein the release tool includes first and second release pins, the first release pin adapted to extend through the first release aperture and engage the first hinge portion, the second release pin adapted to extend through the second release aperture and engage the cam.

10. The hinge mechanism of claim 1, further comprising a secondary securing device having a retaining bracket and a fastener, the retaining bracket having a first member coupled to the cam and a second member which abuts the first hinge portion when the cam is placed in the engaged position, the second member having a fastener aperture, the fastener including a threaded body portion and a head portion having an annular ring, wherein threaded engagement of the fastener to the first hinge portion creates a clamping force which is operable for engaging the annular ring to a groove in the first hinge portion.

11. A hinge mechanism for a structure having a frame and a closure member, the frame defining an aperture, the hinge mechanism comprising:

a first hinge structure having a pair of first pin apertures, the first hinge structure adapted for coupling to one of the closure member and the frame member;

a second hinge structure having a base member and a pair of trunnions, each of the pair of trunnions coupled to the base member and extending perpendicular thereto, each of the pair of trunnions including a second pin aperture;

a hinge pin extending through the first and second pin apertures and pivotably coupling the first and second hinge structures together about a hinge axis;

a pair of locators fixedly coupled to the base member; and a third hinge structure having a securing portion and a mounting portion, the securing portion adapted for coupling to the other of the closure member and the frame member, the mounting portion including a pair of mounting apertures, each of the pair of mounting apertures slidably receiving one of the pair of locators;

wherein sliding engagement between the pair of locators and the pair of mounting apertures aligns the second and third hinge structures in a predetermined manner.

12. The hinge mechanism of claim 11, wherein each of the pair of locators includes a generally cylindrical body portion adapted to engage the third hinge structure.

13. The hinge mechanism of claim 12, wherein each of the pair of locators further includes an insertion portion coupled to the body portion, the insertion portion having a generally conical shape.

14. The hinge mechanism of claim 12, wherein a first one of the pair of mounting apertures is generally cylindrical and a second one of the pair of mounting apertures is slotted along an axis parallel the hinge axis.

15. A hinge mechanism for a structure having a frame and a closure member, the frame defining an aperture, the hinge mechanism comprising:

a hinge assembly having a first hinge structure, a second hinge structure, a hinge pin and a pair of locators, the first hinge structure including a pair of first pin apertures, the first hinge structure adapted for coupling to one the closure member and the frame member, the second hinge structure including a base member and a pair of trunnions, each of the pair of trunnions coupled to the base member and extending perpendicular thereto, each of the pair of trunnions including a second pin aperture, the hinge pin extending through the first and second pin apertures and pivotably coupling the first and second hinge structures together about a hinge axis, the a pair of locators coupled to the base member;

a third hinge structure having a cam follower, a securing portion and a mounting portion, the securing portion adapted for coupling to the other of the closure member and the frame member, the mounting portion including a pair of mounting apertures, each of the pair of mounting apertures operably receiving one of the pair of locators; and a cam coupled to the hinge assembly and movable between a release position and an engaged position, the cam not engaging the cam follower when the cam is in the release position and the cam engaging the cam follower when the cam is in the engaged position;

wherein the cam is in the release position prior to installation of the closure member to the frame and is adapted to be moved into the engaged position upon movement of the closure member from an open position to a closed position, thereafter the cam remaining in the engaged position during normal operation of the closure member;

wherein the pair of locators and the pair of mounting apertures cooperate to align the second and third hinge structures in a predetermined manner.

16. The hinge mechanism of claim 15, wherein the cam follower is a pin member.

17. The hinge mechanism of claim 15, wherein the cam is a hook-shaped structure rotatably coupled to hinge pin.

18. The hinge mechanism of claim 17, wherein the third hinge structure includes a cam aperture, the hook-shaped structure pivoting about the hinge pin and through the cam aperture when the cam is moved to the engaged position.

19. The hinge mechanism of claim 15, wherein the hinge assembly includes a first release aperture and the cam includes a second release aperture, the first and second release apertures adapted to receive a release tool, the release tool adapted to inhibit relative motion between the cam and the closure member.

20. The hinge mechanism of claim 19, wherein the release tool includes first and second release pins, the first release pin adapted to extend through the first release aperture and engage the hinge assembly, the second release pin adapted to extend through the second release aperture and engage the cam.

21. The hinge mechanism of claim 15, wherein each of the pair of locators includes a generally cylindrical body portion adapted to engage the third hinge structure.

22. The hinge mechanism of claim 21, wherein a first one of the pair of mounting apertures is generally cylindrical and a second one of the pair of mounting apertures is slotted along an axis parallel the hinge axis.

23. The hinge mechanism of claim 15, further comprising a secondary securing device having a retaining bracket and a fastener, the retaining bracket having a first member coupled to the cam and a second member which abuts the hinge assembly when the cam is placed in the engaged position, the second member having a fastener aperture, the fastener including a threaded body portion and a head portion having an annular ring, wherein threaded engagement of the fastener to the hinge assembly creates a clamping force which is operable for engaging the annular ring to a groove in the hinge assembly.

* * * * *